United States Patent [19]

Sihon et al.

[11] 4,423,707

[45] Jan. 3, 1984

[54] ENGINE WITH INTERNAL CRANKCASE BRIDGE HAVING INTEGRAL OIL PUMP AND DRIVE HOUSING

[76] Inventors: Tanas M. Sihon, Ann Arbor; Jerry W. Ransom, Livonia, both of Mich.

[21] Appl. No.: 422,576

[22] Filed: Sep. 24, 1982

[51] Int. Cl.[3] ..... F02F 7/00; F02B 77/00

[52] U.S. Cl. ..... 123/196 R; 123/198 E; 123/198 C; 123/195 A; 181/204

[58] Field of Search ..... 123/198 E, 198 C, 195 A, 123/195 C, 195 S, 196 R; 184/6.12, 6.28; 181/204

[56] References Cited

U.S. PATENT DOCUMENTS

| | | | |
|---|---|---|---|
| 2,572,250 | 10/1951 | Davis | 184/6 |
| 2,641,241 | 6/1953 | Skinner | 123/196 A |
| 2,728,413 | 12/1955 | Kremser | 184/6 |
| 2,883,001 | 4/1959 | Dierksen | 184/31 |
| 3,046,954 | 7/1962 | Hoffman et al. | 123/196 R |
| 3,304,134 | 2/1967 | Allen | 308/23 |
| 3,464,398 | 9/1969 | Scheiterlein et al. | 123/198 E |
| 4,183,344 | 1/1980 | Kirchweger | 123/195 C |

*Primary Examiner*—Charles J. Myhre
*Assistant Examiner*—E. Rollins Cross

[57] ABSTRACT

An engine, preferably of the heavy duty diesel internal combustion type, is provided with a crankcase having downwardly extending side walls interconnected by a stiffening bridge member. The bridge member includes integral mounting means for an oil pump and its drive shaft and supports a drive gear that directly engages a driving gear on the engine crankshaft immediately above the assembly.

3 Claims, 5 Drawing Figures

ENGINE WITH INTERNAL CRANKCASE BRIDGE HAVING INTEGRAL OIL PUMP AND DRIVE HOUSING

TECHNICAL FIELD

This invention relates to engines and more particularly to stiffened engine crankcase housings. In a specific embodiment the invention involves a crankcase housing having side walls connected by a stiffening bridge member integrally housing a lubricating oil pump and drive means therefor.

BACKGROUND

Various arrangements have in the past been provided for housing and driving an oil pump as part of a positive pressure oil lubrication system for an engine such as, for example, an automotive gasoline or diesel engine. While it is considered desirable to locate the pump physically near the oil supply, usually within the engine oil pan, requirements for housing, supporting and driving the pump must also be accommodated within the confines of available space and without interference with the functions of other engine elements.

SUMMARY OF THE INVENTION

The present invention provides a novel and advantageous arrangement for housing and driving an engine oil pump in a location within the engine oil pan, ideally located below and between the engine crankcase side walls underneath the engine crankshaft. The arrangement provides for the oil pump and its drive means to be supported in and by a housing formed integrally with a bridge member that connects with and extends between the side walls of the crankcase to interconnect them between their ends for stiffening the wall structure and limiting the occurrence of vibrations therein. The bridge member is connected to sealing surfaces of the walls on which the oil pan is mounted by vibration isolating means, the bridge member being spaced inwardly of the oil pan to preserve its isolation.

These and other features and advantages of the invention will be more fully understood from the following description of a preferred embodiment taken together with the accompanying drawings.

BRIEF DRAWING DESCRIPTION

DETAILED DESCRIPTION

Figure 1:
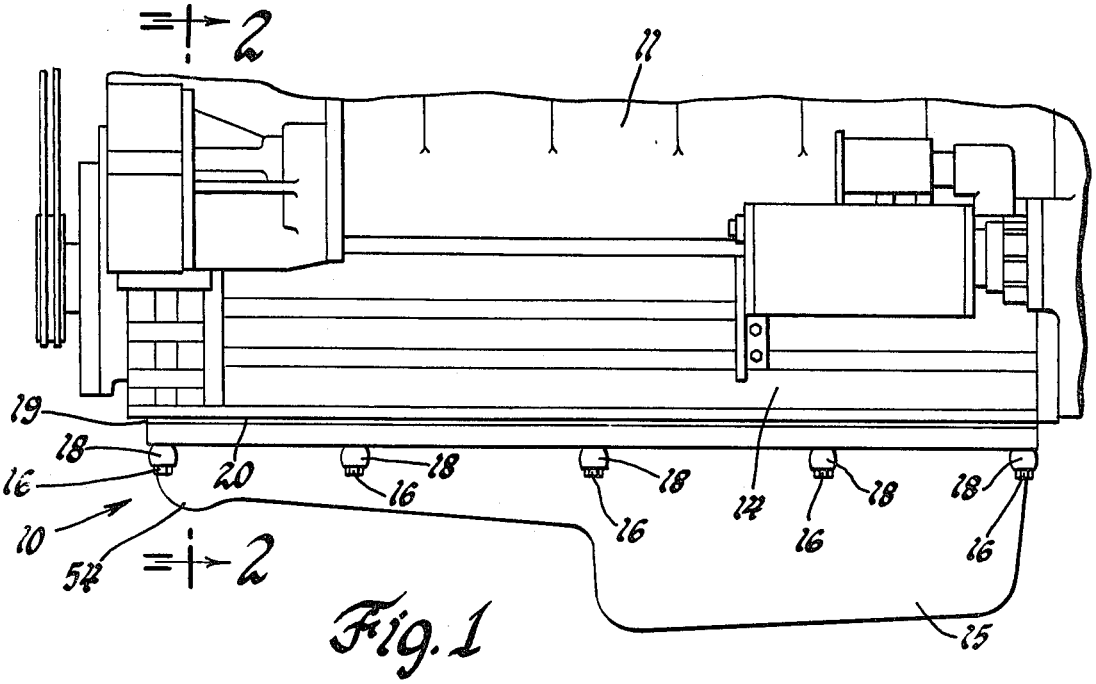
FIG. 1 is a side view of the lower portion of an engine having crankcase bridge means in accordance with the invention.
Figure 2:
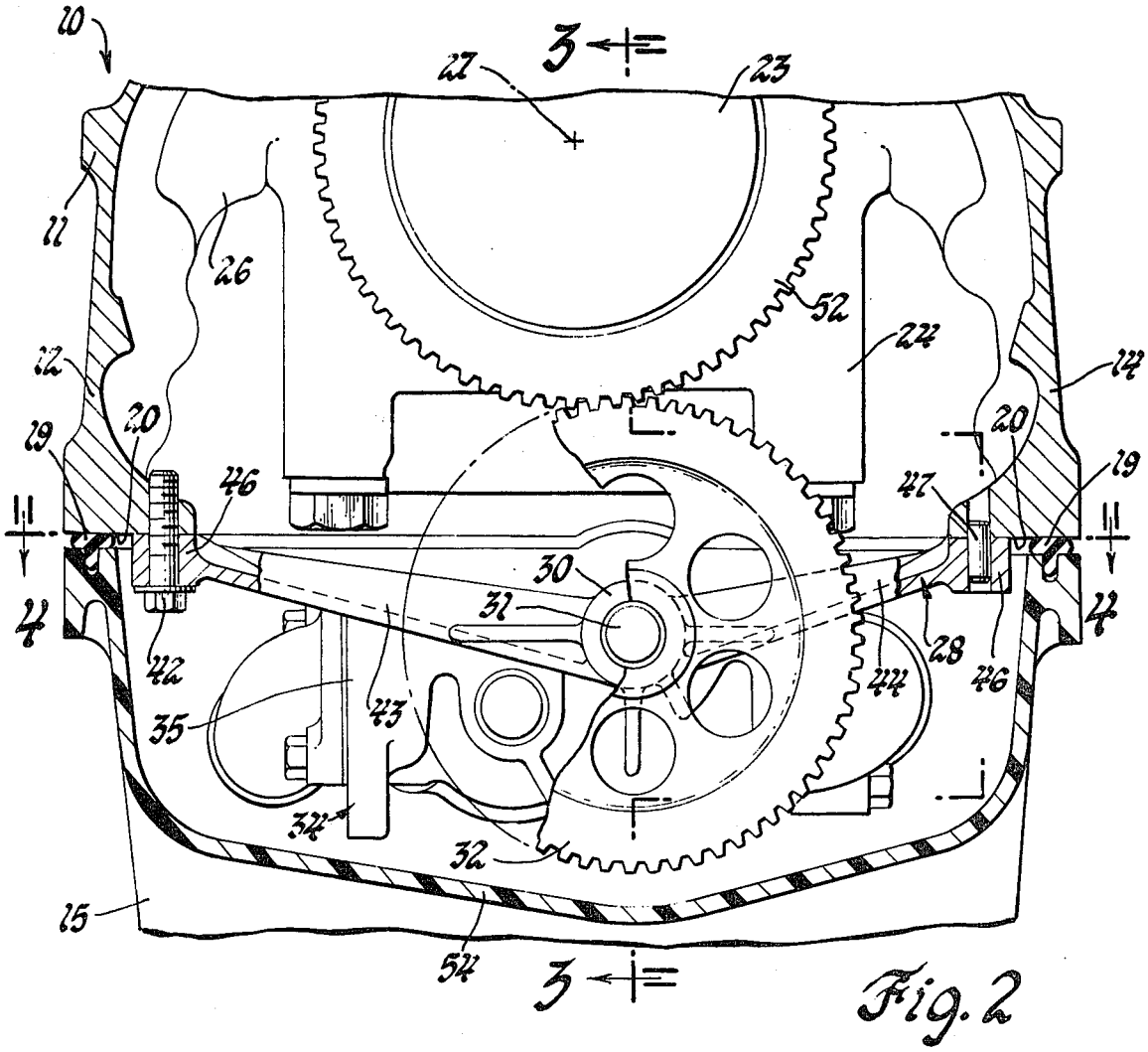
FIG. 2 is a transverse cross-sectional view from the plane indicated by the line 2—2 of FIG. 1 showing the front end of the bridge and pump housing with portions broken away to reveal features of the arrangement.
Figure 3:
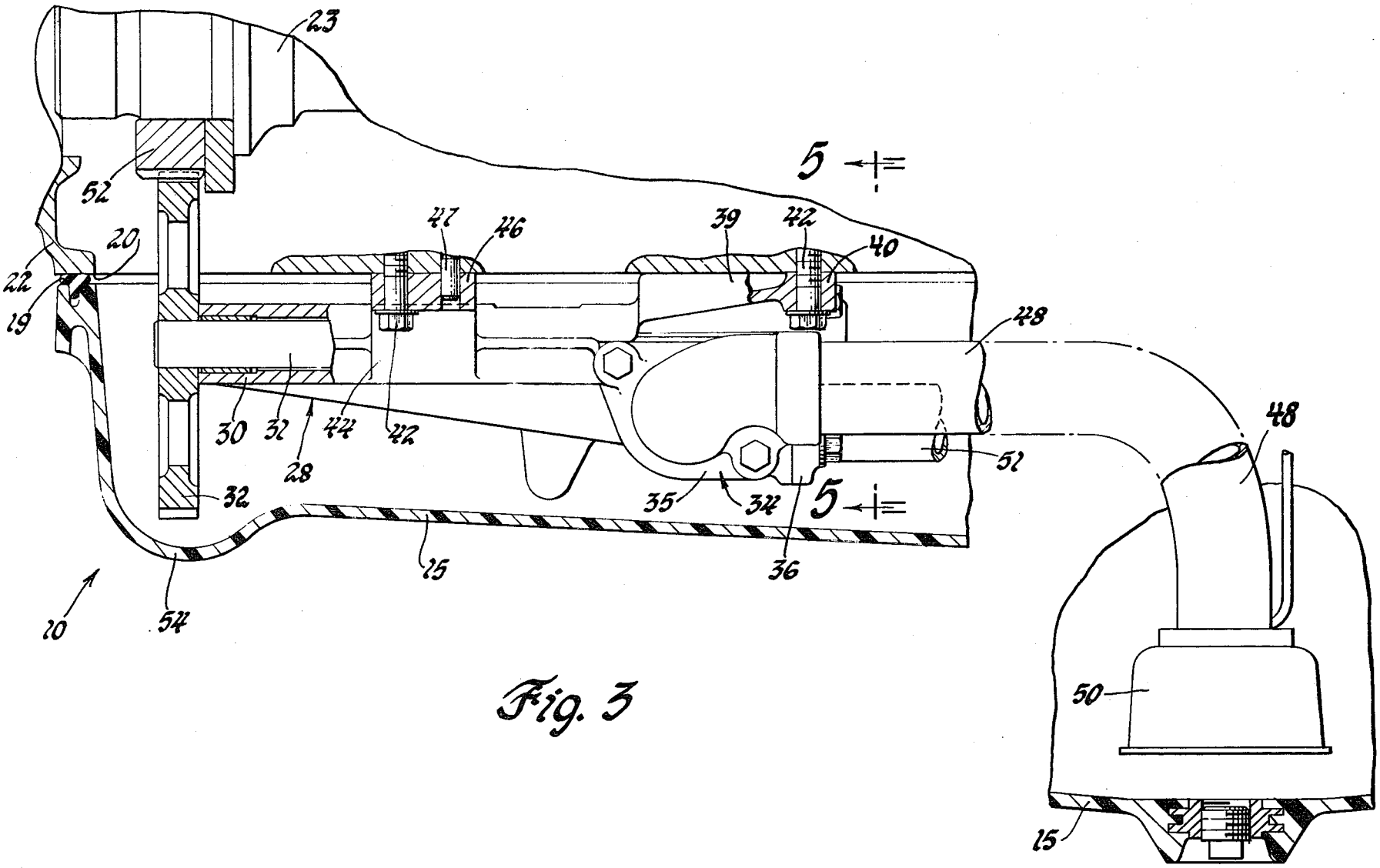
FIG. 3 is a longitudinal cross-sectional view from the planes generally indicated by the line 3—3 of FIG. 2 and illustrating further features of the novel arrangement.
Figure 4:
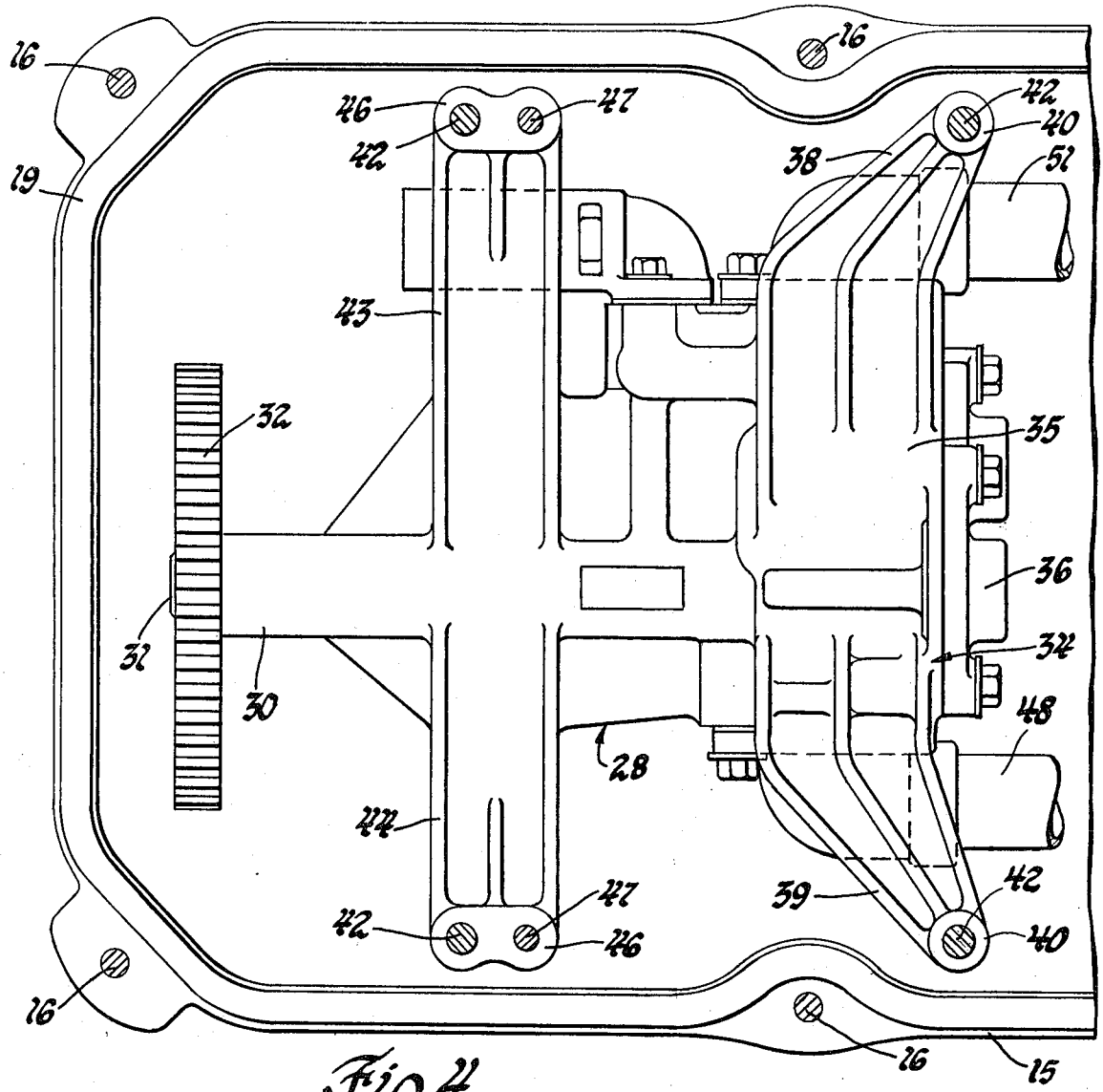
FIG. 4 is a plan view of the oil pan and bridge arrangement of the present invention as seen from the plane indicated by the line 4—4 of FIG. 2.
Figure 5:
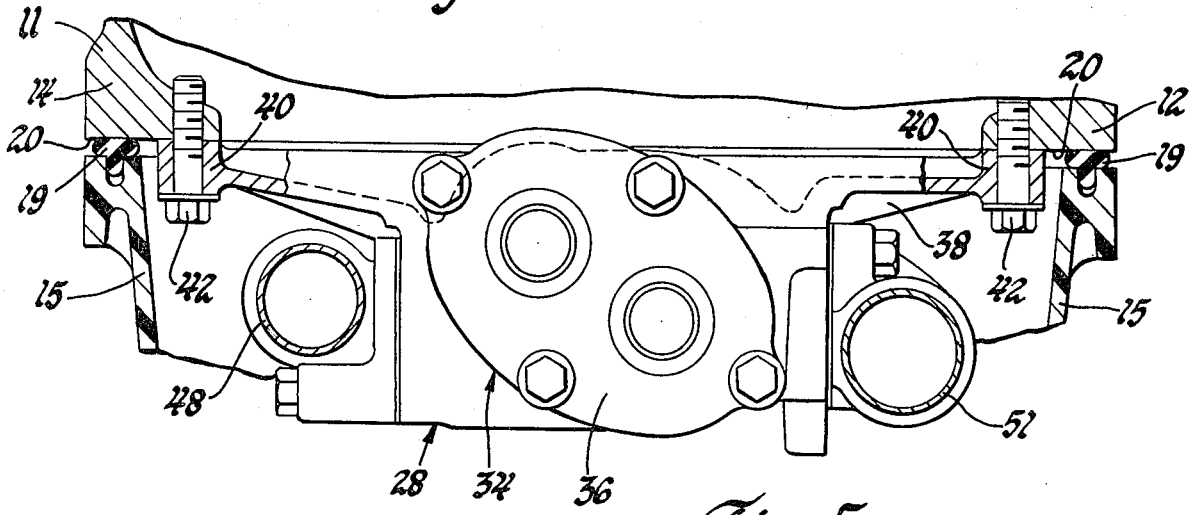
FIG. 5 is a transverse cross-sectional view showing the rear end of the bridge and pump housing with portions broken away as seen from the plane indicated by the line 5—5 of FIG. 3.

Referring now to the drawings in detail. Numeral 10 generally indicates an internal combustion engine of the heavy duty automotive diesel type. Engine 10 includes an integral cylinder block and crankcase 11, the crankcase portion of which is outwardly defined by right and left side walls 12, 14 arranged to support an oil pan 15.

The oil pan may be constructed in any suitable manner but in the illustrated embodiment is formed of a stamped plastic material. A vibration isolating mounting, including bolts 16 engaging the pan through resilient compression members 18 and a resiliently compressible sealing gasket 19 is used to sealingly support the pan against downwardly facing lower mounting and sealing surfaces 20 of the side walls 12, 14. Thus the oil pan provides a lower closure for the crankcase as well as a sump for retention of lubricating oil.

The front and rear ends of the crankcase are likewise sealingly engaged with the oil pan through suitable means 22 interconnecting the side walls and extending the downwardly facing lower sealing surfaces 20 across the front and rear ends of the engine. Means 12 may be comprised for example of removable cover members or integral extensions of the cylinder block and crankcase or of any other suitable forms of constructions for accomplishing the purpose.

Within the engine crankcase, there is rotatably supported a crankshaft 23 conventionally carried on journals, not shown, supported by bearing caps 24 individually secured to transverse webs or bulkheads 26 of the crankcase. In the present construction the sides 12, 14 of the crankcase extend downwardly substantially below the longitudinal rotational axis 27 of the crankshaft to provide skirts which substantially enclose the downwardly extending bearing caps 24 and provide for only a relatively small protrusion below the lower surfaces 20 of the counterweights and connecting rods which are formed as part of or associated with the crankshaft in the operation of the engine.

In accordance with the present invention, the downwardly extending side walls 12, 14 of the engine are transversely stiffened by interconnection at various locations between their ends through the use of suitable bridge members located within the oil pan and secured to and interconnecting the lower edges of the crankcase side walls. Further in accordance with the invention, the forward portions of the side walls 12, 14 are connected by a bridge member 28 which provides integral housing means for mounting an engine oil pump and means for driving the pump through connection with the crankshaft. The mounting of the bridge member to the side walls is inwardly spaced and separate from the oil pan to preserve the pan's vibration isolation from the crankcase.

As preferably constructed in accordance with the invention, the bridge member is formed as an iron casting having a generally central tubular body 30 internally supporting a longitudinally extending drive shaft 31 connected at its opposite ends with a drive gear 32 and with one of the dual gears, not shown, of an oil pump 34 having a housing portion 35 formed integrally with the tubular body 30 and closed by a cover 36 on the rear end of the housing 35. From the oil pump housing portion 35, suitably webbed legs 38, 39 extend laterally to bosses 40 that are secured by bolts 42 to the lower surfaces 20 of the opposite crankcase side walls at predetermined locations. In like manner, a second pair of laterally extending legs 43, 44 extend from the tubular body intermediate the oil pump housing portion and the gear supporting end to bosses 46 which are likewise secured by bolts 42 to the lower surfaces 20 of the side walls at predetermined locations. Bosses 46 are also provided at final assembly with dowel pins 47 for a purpose to be subsequently described.

The oil pump housing portion of the integral bridge device may be formed with suitable internal passages and/or attached devices to provide for oil intake and discharge as well as pressure relief and bypass valves if desired. In the illustrated construction, an intake conduit 48 connects the pump housing with an intake strainer 50 located in the lower sump portion of the oil pan. An outlet conduit 51 also connects the pump housing on the side opposite from the intake conduit to carry lubricating oil from the pump to the oil galleries, not shown, of the engine.

At the front end of the engine, the pump drive gear 32 is drivingly engaged with a driving gear 52 directly carried on the front end of the crankshaft 23 of the engine. Since the front end of the oil pan in the illustrated construction is relatively shallow, as is common, a slight downward protrusion 54 is provided at the front edge of the pan to allow clearance for the drive gear 32. However, the remainder of the pump and drive assembly, including the integral housing and bridge member, is configured to fit within the relatively narrow space provided by the shallow front portion of the oil pan and the working parts of the engine crankshaft with its associated connecting rods and attached counterweights. In this manner an effective yet efficient means is provided for combining the desired functions of mounting the oil pump for the engine within the oil pan near the source of lubricating oil storage and at a relatively low level while also providing a simple two gear drive arrangement. Additionally, the oil pump and drive housing is integrated with bridge means for tying together the engine side walls between their ends to stiffen their structure and reduce possible noise causing vibrations.

The direct connection of the integral bridge and pump assembly to the engine crankcase and the use of the simple two gear drive allow proper gear lash to be established at assembly without the need for shims or other adjustments. Dowel pins 47 are installed between the bridge and crankcase to fix the position of the structure and maintain the proper gear lash upon any subsequent disassembly and reassembly of the bridge and pump unit to the engine crankcase.

While the invention has been described by reference to a selected embodiment chosen for purposes of illustration, it should be understood that numerous changes could be made within the spirit and scope of the inventive concepts described. Accordingly it is intended that the invention not be limited to the details of the disclosed embodiment but that it have the full scope permitted by the language of the following claims.

The embodiments of the invention in which an exclusive property or privilege is claimed are defined as follows:

1. The combination of an engine having a crankcase housing with a pair of longitudinally extending oppositely spaced side walls having interconnected ends, said walls partially defining between them a crankcase cavity in which a crankshaft is supported for rotation on a longitudinal axis, said side walls extending substantially below said axis and being adapted to support an oil pan, a driving member on said crankshaft for driving an oil pump, and the improvement comprising a crankcase bridge member extending laterally across the crankcase cavity beneath the crankshaft and secured to both said side walls between their ends to structurally interconnect them for stiffening and limiting vibrations thereof, said bridge member including integral housing means containing an oil pump connected to draw lubricating oil from within said oil pan, and a drive member carried by said bridge member and directly connected to drive said oil pump, said drive member being positioned closely adjacent to said crankshaft and drivably connecting with said crankshaft carried driving member for driving said oil pump upon rotation of said crankshaft, whereby an engine having a compact crankcase bridge and oil pump housing and drive assembly is provided.

2. The combination of an engine having a crankcase housing with a pair of longitudinally extending oppositely spaced side walls having interconnected ends, said walls partially defining between them a crankcase cavity in which a crankshaft is supported for rotation on a longitudinal axis, said side walls extending substantially below said axis and supporting an oil pan, a driving gear on said crankshaft for driving an oil pump, and the improvement comprising a crankcase bridge member extending laterally across the crankcase cavity beneath the crankshaft and secured to both said side walls between their ends to structurally interconnect them for stiffening and limiting vibrations thereof, said bridge member including an ingegral housing containing an oil pump connected to draw lubricating oil from within said oil pan, and a drive shaft carried by said bridge member and directly connected to drive said oil pump, said drive shaft being positioned closely adjacent and parallel to said crankshaft and carrying a drive gear drivably connecting with said crankshaft carried driving gear for driving said oil pump upon rotation of said crankshaft, whereby an engine having a compact crankcase bridge and oil pump housing and drive assembly is provided.

3. The combination of an engine having a crankcase housing with a pair of longitudinally extending oppositely spaced side walls partially defining between them a crankcase cavity in which a crankshaft is supported for rotation on a longitudinal axis, a driving gear on said crankshaft for driving an oil pump, said side walls extending substantially below said axis with downwardly facing mounting and sealing surfaces at their lower edges, and the improvement comprising an oil pan supported on said side walls by vibration isolation means with seal means engaging said side wall mounting surfaces, and a crankcase bridge member within said oil pan and extending laterally across the crankcase cavity beneath the crankshaft, said bridge member engaging and being secured to the mounting surfaces of both said side walls inwardly of said oil pan to structurally interconnect the side walls for stiffening and limiting vibrations thereof, said bridge member including an integral housing containing an oil pump connected to draw lubricating oil from within said oil pan, and a drive shaft carried by said bridge member and directly connected to drive said oil pump, said drive shaft being positioned closely adjacent and parallel to said crankshaft and carrying a drive gear drivably connecting with said crankshaft carried driving gear for driving said oil pump upon rotation of said crankshaft, whereby an engine having a compact internal crankcase bridge and oil pump housing and drive assembly is provided.

* * * * *

UNITED STATES PATENT AND TRADEMARK OFFICE

CERTIFICATE OF CORRECTION

PATENT NO. : 4,423,707

DATED : January 3, 1984

INVENTOR(S) : Tanas M. Sihon and Jerry W. Ransom

It is certified that error appears in the above—identified patent and that said Letters Patent is hereby corrected as shown below:

On the cover page, before "[21] Appl. No.: 422,576" insert -- [73] Assignee: General Motors Corporation, Detroit, Mich. --; under "[56] References Cited" add -- FOREIGN PATENT DOCUMENTS 1,328,196 8/1973 Great Britain 123/196R --; before "[57] ABSTRACT" insert -- Attorney, Agent or Firm - Robert J. Outland --. Column 2, line 23, for "12" read -- 22 --; line 58, after "having" insert --opposite front and rear ends delimiting --; line 60, after "at" insert -- said front end -- and delete "its opposite ends"; line 61, after "and" insert -- at said rear end --. Column 3, line 3, after "supporting" insert -- front --; line 15, after "connects" insert -- with --. Column 4, line 5, before "secured" insert -- transversely --, after "secured" insert -- only --; line 8, after "member" insert -- having front and rear ends and --, after "including" insert -- at said rear end --; line 14, after "connecting" insert -- at said bridge member front end --; line 31, before "secured" insert -- transversely --, after "secured" insert -- only --; line 34, after "member" insert -- having front and rear ends and --, after "including" insert -- at said rear end --, for "ingegral" read -- integral --; line 40, after "gear" insert -- at said bridge member front end --; line 49, after "walls" insert -- having interconnected ends, said walls --; line 62, after "being" insert -- transversely --, after "secured" insert -- only --; line 63, before "inwardly" insert -- between their ends --; line 66, after "member" insert -- having front and rear ends and --, after "including" insert -- at said rear end --. Column 5, line 4, after "gear" insert -- at said bridge member front end --.

Signed and Sealed this

*Twenty-first* Day of *August 1984*

[SEAL]

*Attest:*

GERALD J. MOSSINGHOFF

*Attesting Officer*

*Commissioner of Patents and Trademarks*